US005774895A

United States Patent [19]

Baldwin

[11] Patent Number: 5,774,895

[45] Date of Patent: Jul. 7, 1998

[54] SPORTS GLOVE WITH ANTI-SLIP LINING

[76] Inventor: Gordon George Baldwin, 15 Sherborne Road, Petts Wood, Orpington, Kent, BR5 1RE, United Kingdom

[21] Appl. No.: 676,572

[22] Filed: Jul. 8, 1996

[51] Int. Cl.[6] ..... A41D 19/00

[52] U.S. Cl. ..... 2/161.1; 2/164

[58] Field of Search ..... 2/159, 160, 161.1, 2/161.2, 161.3, 161.4, 161.6, 161.7, 161.8, 164, 167, 168, 16, 20

[56] References Cited

U.S. PATENT DOCUMENTS

| | | | |
|---|---|---|---|
| 2,785,407 | 3/1957 | Reeder | 2/22 |
| 2,858,542 | 11/1958 | Ogg | 2/161.2 |
| 3,649,967 | 3/1972 | Millman | 2/161.3 |
| 4,186,445 | 2/1980 | Stager | 2/164 |
| 4,316,926 | 2/1982 | Kaminstein | 2/161.8 |
| 4,445,232 | 5/1984 | Nelson | 2/164 |
| 4,570,269 | 2/1986 | Berlese | 2/161.1 |
| 4,751,749 | 6/1988 | Cowhey | 2/164 |
| 4,977,621 | 12/1990 | Richard | 2/161.1 |
| 5,075,144 | 12/1991 | Kakuwa | 2/161.3 |
| 5,164,231 | 11/1992 | Davis | 2/161.3 |
| 5,390,372 | 2/1995 | Hashimoto et al. | 2/161.2 |
| 5,497,602 | 3/1996 | Arnold | 54/44.7 |

FOREIGN PATENT DOCUMENTS

| | | | |
|---|---|---|---|
| 1377384 | 12/1974 | United Kingdom . | |
| 2088729 | 6/1982 | United Kingdom . | |
| 2232338 | 12/1990 | United Kingdom | 2/161.3 |
| 2246504 | 2/1992 | United Kingdom . | |

*Primary Examiner*—Michael A. Neas
*Attorney, Agent, or Firm*—Iandiorio & Teska

[57] ABSTRACT

A sports glove (2) having an inner surface, an outer surface, and an anti-slip member (6) attached to the inner surface of the glove (2), the anti-slip member (6) being such that it is a foamed polyvinyl chloride anti-slip member having a first side which is attached to the inner surface of the glove (2) and a second side which is opposite the first side and which is engaged by a hand (4) when the glove is worn, and the second side of the anti-slip member (6) being such that it has a smooth surface which is effective to grip the hand (4) and thus act to reduce slipping of the glove (2) with respect to the hand (4).

10 Claims, 3 Drawing Sheets

SPORTS GLOVE WITH ANTI-SLIP LINING

This invention relates to a sports glove.

Sports gloves for use in the playing of various types of sports are well known. The sports gloves are usually worn for increasing a player's grip, for example on a golf club if the player is playing a game of golf. Especially in highly competitive games, it is essential that the sports glove provides increased grip under all conditions of use and, for example, slipping may sometimes occur if a player gets hot and the player's hand starts to perspire. Especially in the game of golf, even extremely slight slipping when driving a golf ball from a tee can result in very substantial error in the location of the golf ball at the other end of its flight It is an aim of the present invention to obviate or reduce the above mentioned problem.

Accordingly, in one non-limiting embodiment of the present invention there is provided a sports glove having an inner surface, an outer surface, and an anti-slip member attached to the inner surface of the glove, the anti-slip member being such that it is a foamed polyvinyl chloride anti-slip member having a first side which is attached to the inner surface of the glove and a second side which is opposite the first side and which is engaged by a hand when the glove is worn, and the second side of the anti-slip member being such that it has a smooth surface which is effective to grip the hand and thus act to reduce slipping of the glove with respect to the hand.

During use, if a player wearing the glove becomes hot, the increased heat causes the second side of the anti-slip member to stick more firmly to the hand. This is surprising in that a sports glove without the anti-slip member would normally slip more across a wearer's hand when the wearer became hot and the hand started to perspire. The use of the anti-slip member is further surprising in that a smooth surface would normally be expected to slip but the smooth surface of the foamed polyvinyl chloride acts in the opposite manner. Still further, the smooth surface of the anti-slip member helps to prevent the absorption of water from perspiration into the anti-slip member and this in turn reduces any tendency of the sports glove to smell of stale sweat after use and/or to harbour bacteria which could cause an infection.

The use of the anti-slip member inside the sports glove is also surprising. More especially, as mentioned above, the known sports gloves are usually worn to increase grip on a sporting article such for example as a golf club. Normally, one would think of endeavouring to increase grip by placing the anti-slip member between the sports glove and the sports article, that is on the outside of the sports glove. However, in the present invention the anti-slip member is placed inside the sports glove and this is based upon the realisation that slipping occurs between the wearer's hand and the sports glove and nor between the sports glove and the sports article.

The sports glove may be one in which the anti-slip member is attached to a part of the glove opposite a palm part of the glove for engagement with a back part of the hand. Alternatively, the anti-slip member may be attached to a palm part of the glove fair engagement with a palm part of the hand. Where the anti-slip member is positioned in the sports glove for engagement with the palm part of the hand, then the anti-slip member may reduce the sensitivity of feel permitted by the sports glove for the sports article being held, for example a golf club, Where it is essential that the sensitivity of feel should not be reduced, then it may be preferred to have the anti-slip member positioned in the sports glove for engagement with the back part of the hand.

With such positioning of the anti-slip member, slipping between the hand and the sports glove may be substantially prevented, whilst at the same time sensitivity of feel between the hand and the sports article being gripped through the sports glove may be retained.

If desired, the sports glove may be one in which the anti-slip member is attached to a palm part of the glove for engagement with a palm part of the hand, and is also attached to a part of the glove opposite the palm part of the glove for engagement with a back part of the hand. Such a construction may be employed where sensitivity of grip is less important than eliminating all slipping between the glove and the hand over the part of the hand between the wrist and the fingers. With such an arrangement, the anti-slip member may be a bent over strip of the foamed polyvinyl chloride, a tube of the foamed polyvinyl chlorides or two separate pieces of the foamed polyvinyl chloride.

The anti-slip member may be attached to the inner surface of the glove by sewing and/or an adhesive. Where an adhesive is employed, any suitable and appropriate adhesive may be used.

The smooth surface of the second side of the anti-slip member may be a plate finished smooth surface. The plate finished smooth surface may be formed by allowing the polyvinyl chloride foamed material to contact a hot plate, for example a hot aluminium plate, as the foamed polyvinyl chloride anti-slip member is being formed.

Alternatively, the smooth surface of the second side of the anti-slip member may be a paper finished smooth surface. In this case, the paper finished smooth surface may be produced by allowing the polyvinyl chloride foamed material to contact cold paper such for example as cold silicone paper as the foamed polyvinyl chloride anti-slip member is being formed.

The technique of forming foamed polyvinyl chloride with a plate finished smooth surface or a paper finished smooth surface is known. The ingredients for producing the foamed polyvinyl chloride may be poured into a hopper and gravity fed from the hopper through a pair of rollers. Since gravity feeding is employed, the lowermost side of the formed foamed polyvinyl chloride layer contacts the lowermost roller. The uppermost side of the foamed polyvinyl chloride layer rises due to the presence of a foaming agent in the polyvinyl chloride. The lowermost roller may be a metal roller, for example an aluminium roller, or it may be a cold roller covered with an appropriate release paper such for example as silicone paper.

Usually, the sports glove will be one in which the first side of the anti-slip member has a non-smooth surface. This will usually be due to the above mentioned normal method of producing the foamed polyvinyl chloride anti-slip member. It will usually be unimportant as to the degree of smoothness of the first side of the anti-slip member because this first side is attached to the inner surface of the glove so that slipping of the first side relative to the glove was not a problem. If desired the anti-slip member could be manufactured for the first side also to be shiney but, as indicated above, it is simpler to manufacture the anti-slip member such that only the second side is shiney.

The anti-slip member may have a Shore hardness of 10–30. A presently preferred Shore hardness is 20. The Shore hardness gives a measure of the density of the foam and the density of the foam in turn relates to the flexibility and degree of absorption of the foam. Generally, the density of the foam can be varied to suite the particular sport for which the sports glove is to be used so that, for example, in some cases a thinner layer of the anti-slip member may be preferred where sensitivity of feel is all important, and in some cases a thicker layer of the anti-slip member may be preferred for example in those cases where absorption of blows is more important than sensitivity of feel.

The anti-slip member may be 1–10 mm thick. Preferably, the anti-slip member is 1–5 mm thick.

The anti-slip member may have a density of 100–200 kg/m$^3$. Preferably the anti-slip member has a density of 130–160 kg/m$^3$.

The anti-slip member in the sports glove may be of any suitable size and shape. Thus the anti-slip member may be produced to conform to the shape of the palm of a person's hand and/or the back of a person's hand.

Generally, it is friction that enables the anti-slip member to function. Thus the sports glove should be a precise fit as worn and it should not be loose. Clenching of the hand, for example to grip a sports article will usually cause the sports glove to get tighter and thus ensure the required gripping of the hand by the anti-slip member.

If desired, the sports glove may include glove tightening means. The glove tightening means may be a strap or an elasticated portion. The strap or the elasticated portion may operate over a part of the sports glove adjacent a back part of the wearer's hand, or over a wrist part of the sports glove. A strap may be preferred where the sports glove is to be used for golf and similar sports where a sports article is gripped. The strap may be tightened by a Velcro (Registered Trade Mark) strip. An elasticated portion may be preferred where the sports glove is to be used as a boxing glove or as a training glove for punching a sports bag.

The sports glove may include a ventilation aperture or apertures.

The ventilation aperture or apertures may extend through a part of the sports glove not provided with the anti-slip member. Alternatively, the ventilation aperture or apertures may extend through a part of the glove provided with the anti-slip member, the ventilation aperture or apertures then extending through the anti-slip member.

The ventilation apertures may be round holes of, for example 1–2 mm diameter. Other types of ventilation apertures may be employed. The ventilation aperture or apertures may be positioned wherever suitable and appropriate on the sports glove.

The sports glove may be constructed and designed to be suitable for any type of sport Thus, for example the sports glove may be golf glove, a gymnastics glove, a shooting glove, a boxing glove, a training glove for punching a boxing bag, or a sports glove for holding a racket such for example as a squash racket, tennis racket or a badminton racket.

Embodiments of the invention will now be described solely by way of example and with reference to the accompanying drawings in which.

Figure 1:
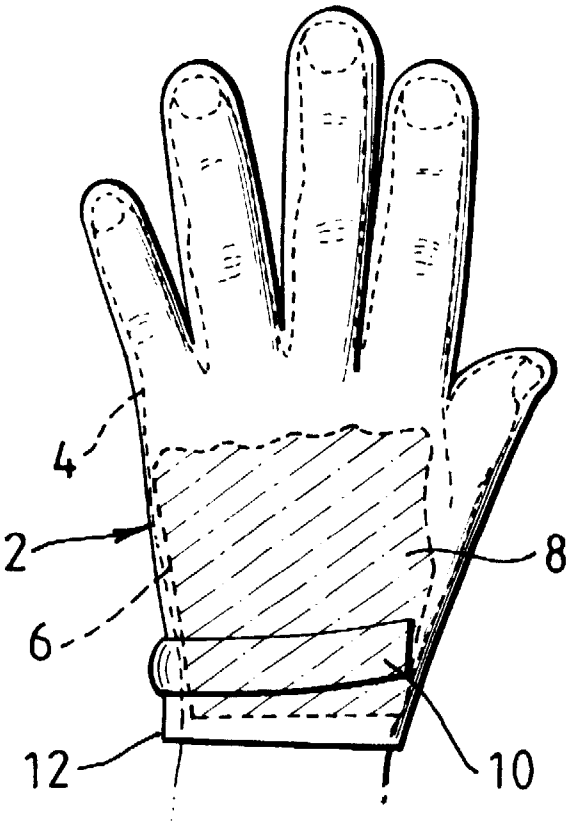
FIG. 1 shows a first sports glove.

Referring to FIG. 1, there is shown a sports glove 2 provided on a person's hand 4. The sports glove 2 has an inner surface, an outer surface, and an anti-slip member 6 attached to the inner surface of the sports glove 2. The anti-slip member 6 is attached to a part 8 of the sports glove 2 opposite a palm part of the glove for engagement with a back part of the hand 4.

The sports glove 2 is provided with glove tightening means in the form of a Velcro strap 10 which is attached to a wrist part 12 of the sports glove 20

Figure 2:
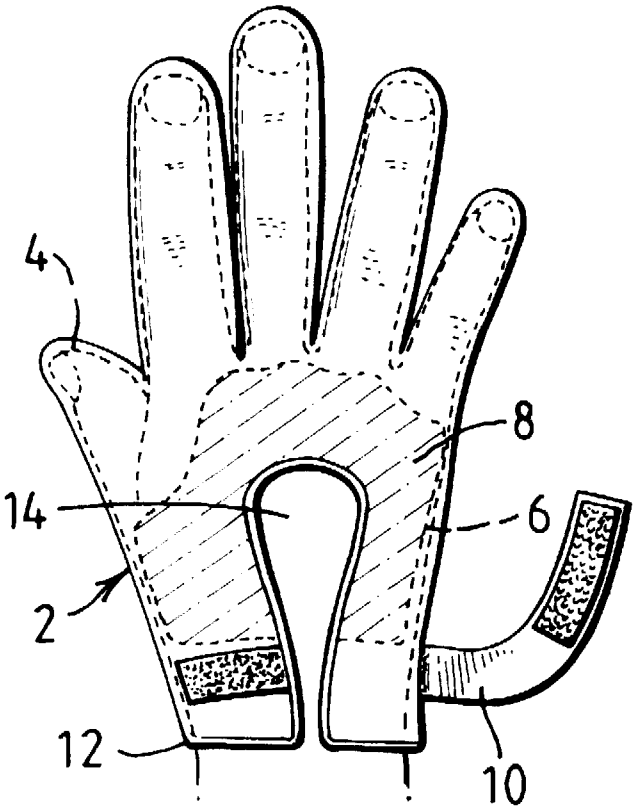
FIG. 2 shows a second sports glove.

Referring now to FIG. 2, there is shown a right-handed sports glove 2 as compared with the lefthanded sports glove 2 shown in FIG. 1. The sports glove 2 shown in FIG. 2 has a ventilation aperture 14 which extends through the anti-slip member 6 and the back of the sports glove 2. The ventilation aperture 14 is for helping to provide ventilation on the inside of the sports glove 2 whilst the spurts glove 2 is being worn.

Figure 3:
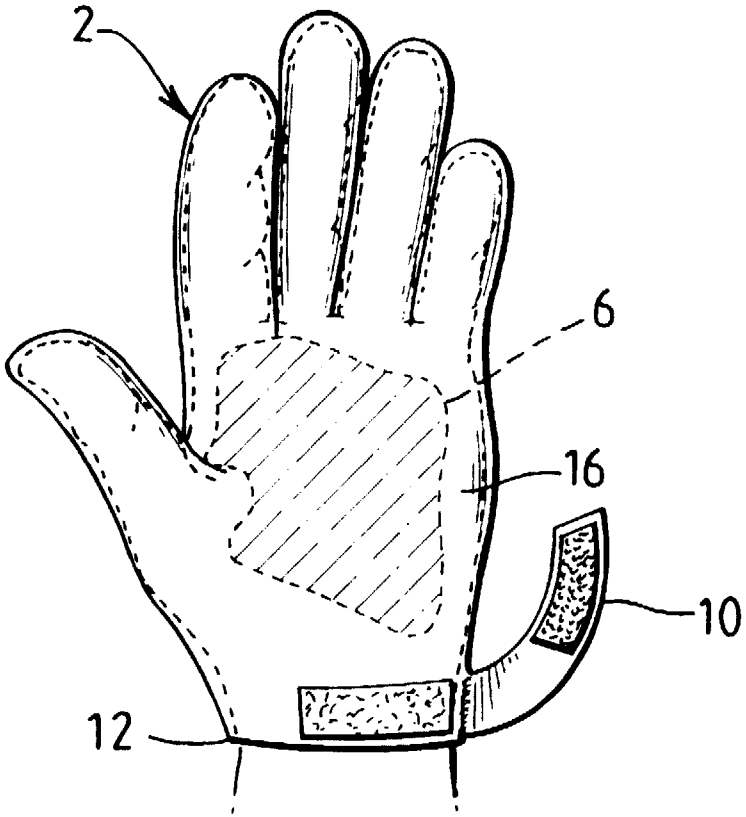
FIG. 3 shows a third sports glove.

FIG. 3 shows a left-handed sports glove 2 having an anti-slip member 6 of a palm part 16 of the sports glove 2.

Figure 4:
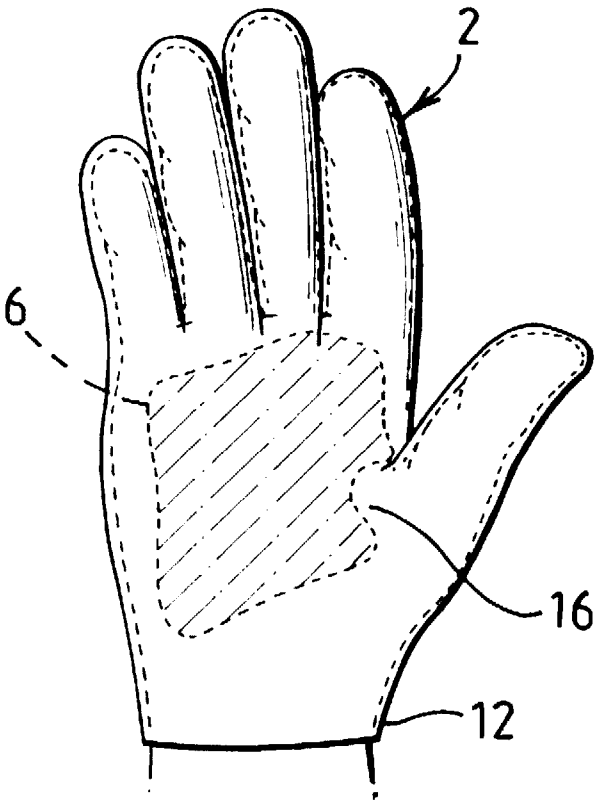
FIG. 4 shows a fourth sports glove.

FIG. 4 shows a right-handed sports glove 2 which is similar to the sports glove 2 shown in FIG. 3 except that it does not have the Velcro strap 10.

Figure 5:
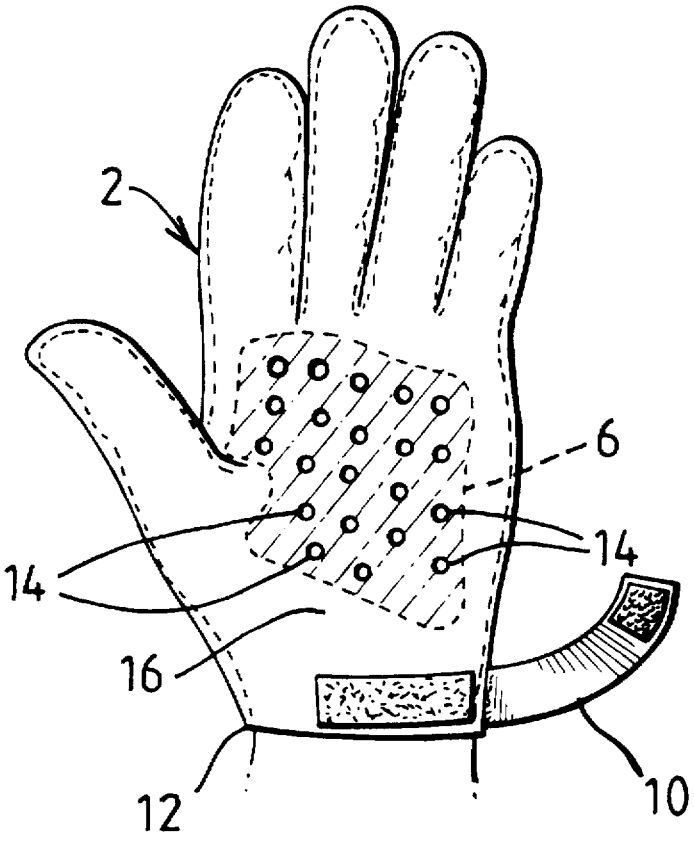
FIG. 5 shows a fifth sports glove.

FIG. 5 shows a sports glove 2 which is like the sports glove 2 shown in FIG. 3 except that the anti-slip member 6 is provided with a plurality of ventilation apertures 14 which extend through the anti-slip member 6 and the palm part 16 of the sports glove 2. The ventilation apertures 14 as shown in FIG. 5 are in the form of a plurality of small round holes.

It is to be appreciated that the embodiments of the invention described above with reference to the accompanying drawings have been given by way of example only and that modifications may be effected. Thus, for example, the sports glove 2 shown in FIGS. 1 to 5 is a golf glove but the illustrated sports glove 2 may be used in other sports or it may be differently designed to be more appropriate for other sports. Also, an elasticated portion could be employed as glove tightening means instead of the Velcro strap 10. The sports glove 2 can also be in the form of a mitten if finger portions were not preferred. The anti-slip member 6 is secured to the inner surface of the sports glove 2 by sewing and/or an adhesive but other means of attaching the anti-slip member to the sports glove of the invention may be employed if desired.

I claim:

1. A sports glove having an inner surface, an outer surface, and an anti-slip member attached to the inner surface of the glove, the anti-slip member being such that it is a foamed polyvinyl chloride anti-slip member having a first side which is attached to the inner surface of the glove and a second side which is opposite the first side and which is engaged by a hand when the glove is worn, and the second side of the anti-slip member being such that it has a smooth surface which is effective to grip the hand and thus act to reduce slipping of the glove with respect to the hand.

2. A sports glove according to claim 1 in which the anti-slip member is attached to a part of the glove opposite a palm part of the glove for engagement with a back part of the hand.

3. A sports glove according to claim 1 in which the anti-slip member is attached to a palm part of the glove for engagement with a palm part of the hand.

4. A sports glove according to claim 1 in which the anti-slip member is attached to a palm part of the glove for engagement with a palm part of the hand, and is also attached to a part of the glove opposite the palm part of the glove for engagement with a back part of the hand.

5. A sports glove according to claim 1 in which the smooth surface of the second side of the anti-slip member is a plate finished smooth surface.

6. A sports glove according to claim 1 in which the smooth surface of the second side of the anti-slip member is a paper finished smooth surface.

7. A sports glove according to claim 1 in which the first side of the anti-slip member has a non-smooth surface.

8. A sports glove according to claim 1 in which the anti-slip member has a Shore hardness of 10–30, in which the anti-slip member is 1–10 mm thick, and in which the anti-slip member has a density of 100–200 kg/m$^3$.

9. A sports glove according to claim 1 and including glove tightening means.

10. A sports glove according to claim 1 and including at least one ventilation aperture, the ventilation aperture being such that it extends through a part of the sports glove provided with the anti-slip member, the ventilation aperture then extending through the anti-slip member.

* * * * *